US005941380A

United States Patent [19]

Rothman

[11] Patent Number: 5,941,380

[45] Date of Patent: Aug. 24, 1999

[54] DEVICE FOR DISPENSING FLOWABLE MATERIAL

[76] Inventor: David Rothman, 17006 Addison St., Encino, Calif. 91316

[21] Appl. No.: 09/005,435

[22] Filed: Jan. 10, 1998

[51] Int. Cl.[6] ..... B65D 25/08

[52] U.S. Cl. ..... 206/222; 206/219; 222/129; 239/272

[58] Field of Search ..... 222/129, 83, 189.06; 239/272, 309; 206/219, 220, 221, 222; 215/6, 228, DIG. 8; 220/521, 258

[56] References Cited

U.S. PATENT DOCUMENTS

| | | | |
|---|---|---|---|
| 2,275,567 | 3/1942 | Smith | 206/219 |
| 2,631,521 | 3/1953 | Atkin, Jr. | 206/219 |
| 3,441,179 | 4/1969 | Ragan | 222/129 |
| 3,467,282 | 9/1969 | Schwartzman | 222/129 |
| 4,221,291 | 9/1980 | Hunt | 222/129 |
| 4,307,821 | 12/1981 | McIntosh | 222/129 |
| 4,615,437 | 10/1986 | Finke et al. | 206/222 |
| 4,982,875 | 1/1991 | Pozzi et al. | 222/129 |
| 5,000,314 | 3/1991 | Fuller et al. . | |
| 5,525,299 | 6/1996 | Lowe . | |
| 5,529,179 | 6/1996 | Hanson | 206/219 |

*Primary Examiner*—Andres Kashnikow
*Assistant Examiner*—Dinh Q. Nguyen

[57] ABSTRACT

A storage cap having a storage compartment, an aperture on the storage compartment, a rupturable membrane covering the aperture, and a receiving groove that engages a bottle, holds a measured amount of a powdered, granulated, or other flowable form of food or drug and provides for quickly, easily, neatly, and completely dispensing the food or drug into a typical 16 oz. to 1.5 liter water bottle. A preferred embodiment of the storage cap is filled with powdered flavor concentrate, and the aperture and the receiving groove are covered with the rupturable membrane. To dispense the powdered concentrate into a bottle, the storage cap is placed with the receiving groove facing the bottle neck lip. The storage cap is then pushed against the lip which urges the rupturable membrane into the groove. As the rupturable membrane is urged into the groove, the rupturable membrane is ruptured thus allowing the concentrate, but not the rupturable membrane, to flow into the bottle. This preferred embodiment storage cap has a receiving groove with a large enough outer diameter, and an aperture that is narrow enough, for engaging the storage cap onto a number of different size bottle openings.

3 Claims, 3 Drawing Sheets

DEVICE FOR DISPENSING FLOWABLE MATERIAL

BACKGROUND OF THE INVENTION

This invention relates generally to the field of dispensers, and more particularly to a device for dispensing flowable material into a container.

Food and drug manufacturers market many concentrated products, erg., powdered drinks and granulated medications which consumers add to a liquid after purchase. These food and drug products are typically sold in packets, jars, cans, and other similar packages, either in bulk or single size servings. It is easy to dispense a serving of powdered flavor concentrate or a dose of granulated medicine from any of those packages into a glass of water or other liquid; however, servings or doses cannot quickly, easily, neatly, and completely be dispensed from those packages directly into a typical narrow necked 16 oz. or 1.5 liter bottle of water or other liquid.

This invention provides food and drug manufacturers with a novel, inexpensive, consumer friendly dispenser that holds single servings or doses of flowable food and drug products and lets consumers easily, quickly, and neatly dispense those products into typical beverage bottles.

Numerous container caps, lids, and other devices that hold and dispense materials are generally well known in the art. Reference is made to U.S. Pat. Nos. 5,529,179 and 5,525,299 and 5,000,314.

In particular U.S. Pat. No. 5,529,179 describes a dispensing lid for the circular upper rim of a drinking cup. Frangible vessels which contain condiments and are fabricated of thin plastic film are disposed within the base panel. When finger pressure is applied to the vessels, their undersides break, thereby discharging the condiments into a drinking cup.

U.S. Pat. No. 5,525,299 describes a cap having two chambers that provide a means for and a method of decomposing or neutralizing a hazardous chemical residue. The cap is threaded to fit a particular container. To release the contents of the storage compartment the cap must be removed from the container opening, the storage compartment seal removed, and the cap replaced on the container.

U.S. Pat. No. 5,500,314 describes a unit dose storage cap. The storage cap includes a dose container meant to contain and dispense a large dose of infant and adult nutritional formulas. The dose container has a threaded mouth designed to be fitted onto the wide neck of a specific graduated infant formula bottle. In use a foil seal is removed before the storage cap is secured to the bottle. In another embodiment of the invention the dose cap has a water soluble seal which dissolves into the formula bottle. The dissolved seal adds an additional substance to the mixture. The water soluble seal does not allow the storage cap to store liquid concentrates.

Deficiencies in the prior art are evident. Typically a package or a cap in the prior art can be used only with a particular container. Frequently prior art devices must be unsealed prior to engaging the device onto a container for dispensing the stored material into the container. In cases where the material may be dispensed after the device is engaged onto to the container, the seal falls into or dissolves into the container with the dispensed material. The prior art does not reveal a device that engages onto any among a number of containers having different neck sizes and different aperture sizes.

SUMMARY OF THE INVENTION

The primary object of the invention is to provide a dispenser that can engage a bottle neck with a narrow aperture to neatly and completely dispense a powdered, granulated, or other flowable form of a food or drug into the bottle.

Another object of the invention is to provide a novel small dispenser to hold a measured amount of a powdered, granulated or other flowable form of a food or drug.

Another object of the invention is to provide a dispenser that can engage any among a number of bottles whose necks and neck apertures differ in size.

A further object of the invention is to provide a dispenser that quickly and easily engages a bottle neck.

Yet another object of the invention is to provide an inexpensive dispenser.

Still yet another object of the invention is to provide a dispenser that is easy to fill and seal.

Other objects and advantages of the present invention will become apparent from the following descriptions, taken in connection with the accompanying drawings, wherein, by way of illustration and example, an embodiment of the present invention is disclosed.

A device for dispensing flowable material, in accordance with a preferred embodiment of the invention, is a storage cap with: a storage compartment to hold a powdered, granulated, or other flowable form of food or drug; an aperture to allow the food or drug to flow out of the storage compartment; a thin plastic or aluminum foil rupturable membrane to cover the aperture; a receiving groove to engage the storage cap onto any among a number of bottles with different size bottle necks and bottle neck apertures; and means to open the rupturable membrane while engaging the storage cap onto a bottle opening to dispense the material that is in the storage compartment, but not the membrane itself, into the engaged bottle.

The drawings constitute a part of this specification and include an exemplary embodiment to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

A detailed descriptions of the preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
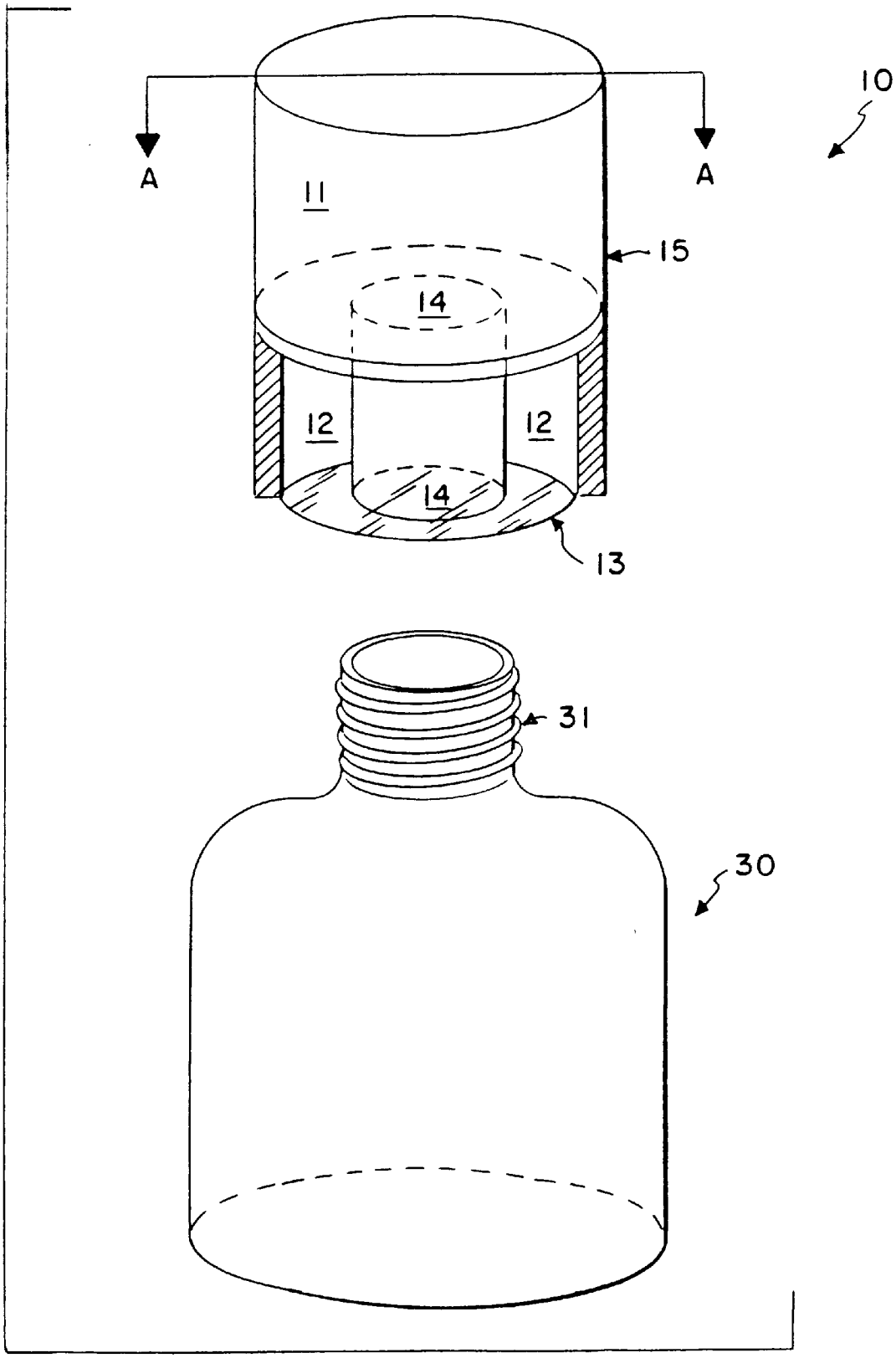
FIG. 1 is a perspective view of the invention partly cut away and of a typical bottle.
Figure 2:
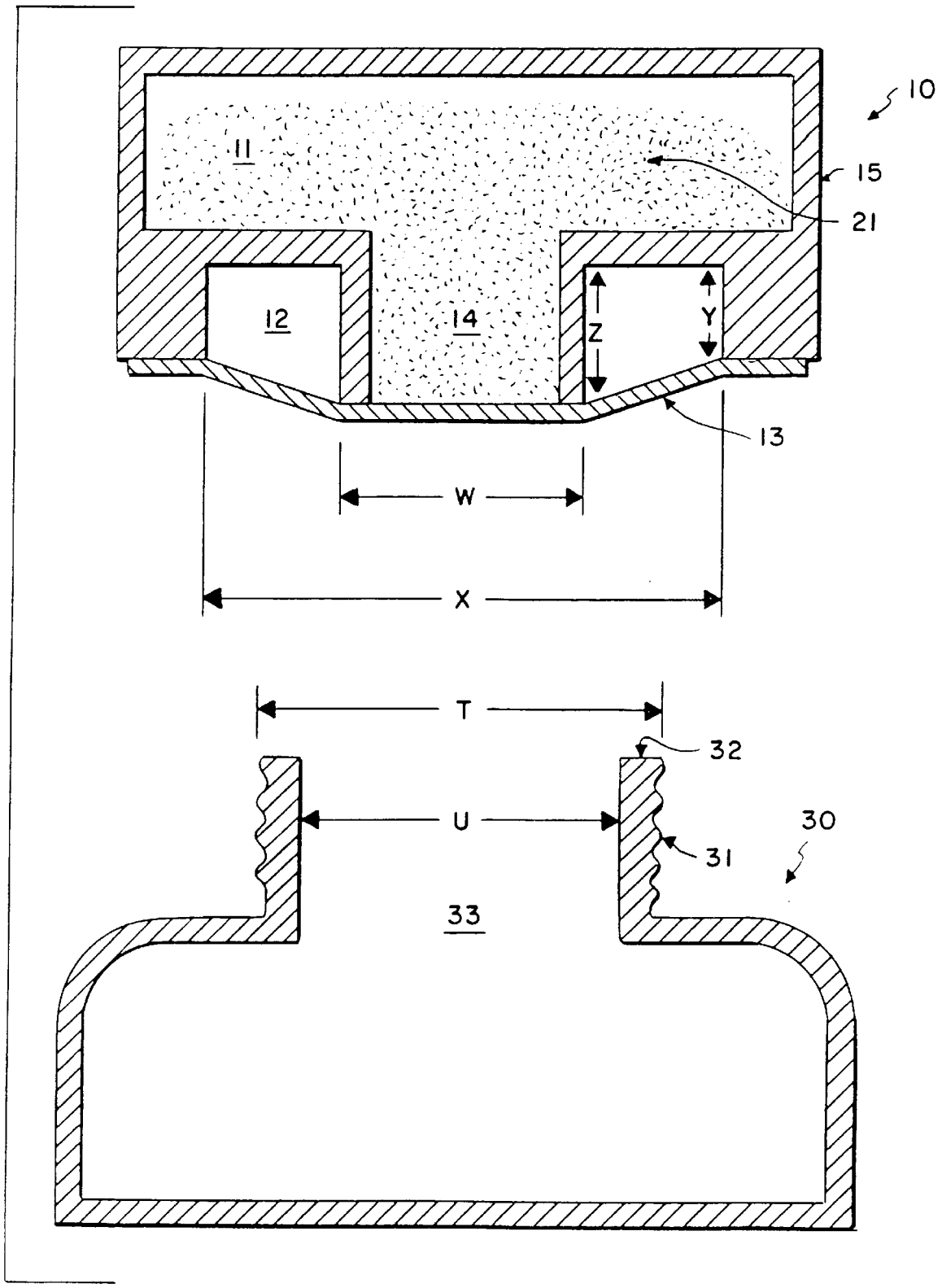
FIG. 2 is a cross sectional view of the invention taken in the direction of the arrows upon the line A—A of FIG. 1 and of a typical bottle.
Figure 3:
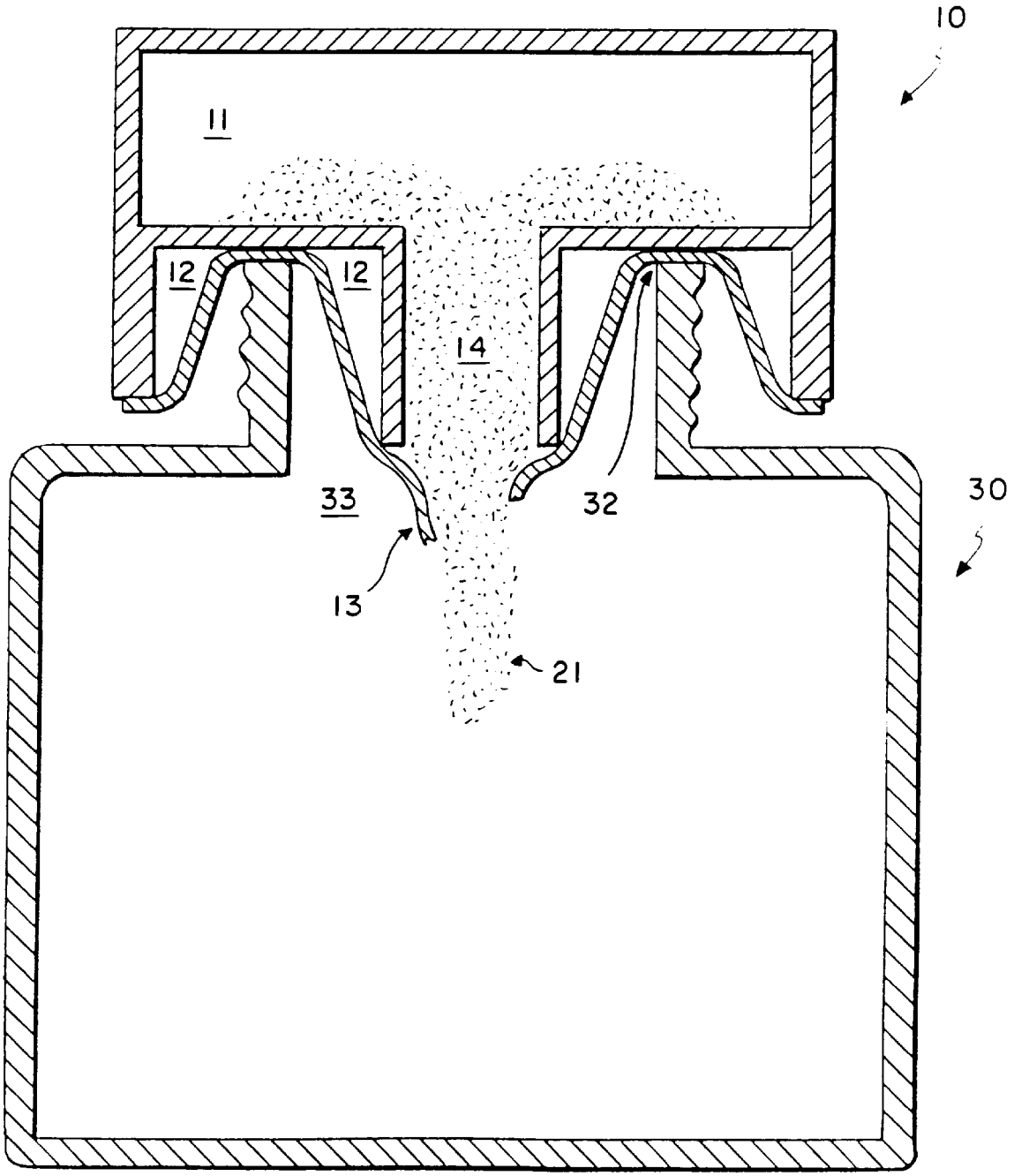
FIG. 3 is the same view as FIG. 2, but with the invention engaged onto a typical bottle.

Referring initially to FIGS. 1–3 an embodiment of the invention is shown together with a typical bottle. Turning first to FIG. 1 there is shown, generally at 10, a storage cap, an embodiment of the present invention, and, generally at 30, a receptacle, a typical bottle, which the storage cap may engage. While storage cap 10 will be discussed hereinafter as containing a powdered flavor concentrate, and further while bottle 30 will be discussed as being a typical 16 oz. to 1.5 liter P.E.T. water bottle containing water, it will be understood that this is for ease of explanation and that the contents of storage cap 10 are not to be construed as being so limited and that bottle 30 and its contents are not so limited. Storage cap 10 engages onto typical bottle neck 31 and the concentrate is dispensed into bottle 30 in a manner as shown in FIG. 3 and described shortly.

Turning now to FIG. 2, storage cap 10 includes a generally hollow cylindrical body 15; a generally circular receiving groove 12; a storage compartment 11 enclosed by body 15; an aperture 14 joining storage compartment 11 to the exterior of body 15; and a rupturable covering 13 attached to body 15 covering aperture 14 and receiving groove 12.

In practice storage compartment 11 is filled with a powdered flavor concentrate 21 of a type well known in the art, then aperture 14 and receiving groove 12 are covered with rupturable covering 13, all done in a sanitary environment using high speed filling and sealing equipment which need not be disclosed here because it is well known in the art. Body 15 may be made of plastic material that meets government regulations for containing foods and drugs. Rupturable covering 13 may be made of thin plastic, aluminum foil, or other thin, slightly elastic, material that meets government regulations for containing foods and drugs.

Referring now to FIG. 3, when storage cap 10 is urged against bottle neck lip 32, bottle neck lip 32 urges rupturable covering 13 into receiving groove 12. As rupturable covering 13 stretches into receiving groove 12, rupturable covering 13 is ruptured at aperture 14 allowing the powdered concentrate to flow from storage compartment 11 through aperture 14, through bottle neck aperture 33, into bottle 30. Storage cap 10 is held against bottle neck lip 32 while the bottle is shaken to insure all the powdered concentrate is washed out of storage compartment 11 and mixed with the water in bottle 30. Ruptured rupturable covering 13, which has been urged into receiving groove 12 while remaining attached to body 15, helps prevent leakage between receiving groove 12 and bottle lip 32.

Returning back to FIG. 2, length Z of receiving groove 12 is slightly longer than length Y of receiving groove 12. The longer length Z causes rupturable covering 13 to rupture at aperture 14 when rupturable covering 13 is forced into receiving groove 12 by bottle neck lip 32.

Still looking at FIG. 2, diameter W of receiving groove 12 is smaller than inner diameter U of the narrowest bottle aperture 33 among the number of bottles that may be engaged with storage cap 10. Diameter X of receiving groove 12 is greater than the outer diameter T of the widest bottle neck among the number of bottles that may be engaged with storage cap 10.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A device for dispensing a flowable material into any receptacle randomly selected from a predefined group of receptacles, whose neck and mouth sizes, and shapes, may differ comprising:

a body, said body defining a storage compartment able to hold the flowable material;

an aperture in communication with said storage compartment and through which the flowable material can flow from said storage compartment;

a generally tubular wall protruding from said body, said tubular wall defining said aperture, and said tubular wall's radius smaller than the radius of the smallest receptacle mouth in the predefined group;

a generally flat area surrounding said tubular wall on the surface of said body;

a generally cylindrical barrier protruding from said flat area and encircling said tubular wall, said cylindrical barrier's center at the approximate center of said aperture, and said cylindrical barrier's radius greater than the radius of the largest receptacle neck in the predefined group;

a generally cylindrical receiving groove formed by said cylindrical barrier, said flat area, and said tubular wall for engaging said device onto the upper end of the neck, and against the mouth, of the receptacle to insert said tubular wall into the mouth of the receptacle to connect said storage compartment to the interior of the receptacle;

a rupturable covering over the exposed open end of said tubular wall to cover said aperture to restrain flowable material within the confines of said storage compartment; and said rupturable covering attached to said cylindrical barrier to compel the neck and mouth of the receptacle to contact and to rupture said rupturable covering when said receiving groove is urged onto the receptacle neck thereby allowing the flowable material to flow from said storage compartment into the engaged receptacle.

2. A device for dispensing a flowable material into any receptacle randomly selected from a predefined group of receptacles, whose neck and mouth sizes, and shapes, may differ comprising:

a body, said body defining a storage compartment able to hold the flowable material;

an aperture in communication with said storage compartment and through which the flowable material can flow from said storage compartment;

a generally tubular wall protruding from said body, said tubular wall defining said aperture, and said tubular wall's radius smaller than the radius of the smallest receptacle mouth in the predefined group;

a generally flat area surrounding said tubular wall on the surface of said body for engaging said device against the upper neck surface and the mouth of the randomly selected receptacle to insert said tubular wall into the mouth of the receptacle to connect said storage compartment to the interior of the receptacle;

a rupturable covering over the exposed open end of said tubular wall to cover said aperture to restrain flowable material within the confines of said storage compartment; and said rupturable covering attached to said flat area along a generally circular line which encircles said tubular wall, the line's center at the approximate center of said aperture, and the line's radius greater than the radius of the largest receptacle neck in the predefined group, thereby forming a tent over said flat area to compel the neck and the mouth of the receptacle to contact and to rupture said ruprurable covering when said flat area is urged against the randomly selected receptacle neck thereby allowing the flowable material to flow from said storage compartment into the engaged receptacle.

3. A device for dispensing a flowable material into a receptacle comprising:

a body, said body defining a storage compartment able to hold the flowable material;

an aperture in communication with said storage compartment and through which the flowable material can flow from said storage compartment;

a generally tubular wall protruding from said body, said tubular wall defining said aperture and able to fit within the mouth of the receptacle;

a generally flat area surrounding said tubular wall on the surface of said body;

a generally cylindrical barrier protruding from said flat area and encircling said tubular wall, said cylindrical barrier having threading adapted to engage reciprocal threading on the neck of the receptacle;

a generally cylindrical receiving groove formed by said cylindrical barrier, said flat area, and said tubular wall for threadely engaging said device onto the upper end of the receptacle neck to insert said tubular wall into the mouth of the receptacle to connect said storage compartment to the interior of the receptacle;

a rupturable covering over the exposed open end of said tubular wall to cover said aperture to restrain flowable material within the confines of said storage compartment; and said rupturable covering attached to said cylindrical barrier to compel the neck and mouth of the receptacle to contact and to rupture said rupturable covering when said receiving groove is threadely engaged onto the receptacle neck thereby allowing the flowable material to flow from said storage compartment into the engaged receptacle.

* * * * *